US009195183B2

(12) United States Patent
Yamashina et al.

(10) Patent No.: US 9,195,183 B2
(45) Date of Patent: Nov. 24, 2015

(54) IMAGE FORMING APPARATUS WITH CONVEYANCE UNIT TO REGULATE PASSAGE OF RECORDING MEDIUM

(71) Applicants: Ryota Yamashina, Kanagawa (JP); Hiroshi Seo, Kanagawa (JP); Takashi Seto, Kanagawa (JP); Arinobu Yoshiura, Kanagawa (JP)

(72) Inventors: Ryota Yamashina, Kanagawa (JP); Hiroshi Seo, Kanagawa (JP); Takashi Seto, Kanagawa (JP); Arinobu Yoshiura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/473,448

(22) Filed: Aug. 29, 2014

(65) Prior Publication Data

US 2015/0071661 A1 Mar. 12, 2015

(30) Foreign Application Priority Data

Sep. 6, 2013 (JP) ..... 2013-185358

(51) Int. Cl.
*G03G 15/20* (2006.01)

(52) U.S. Cl.
CPC ..... *G03G 15/2028* (2013.01)

(58) Field of Classification Search
CPC ..... G03G 15/505; G03G 15/2078; G03G 15/6658; G03G 15/6576; G03G 15/5029; G03G 2215/00738
See application file for complete search history.

(56) References Cited

U.S. PATENT DOCUMENTS 5,787,330 A * 7/1998 Funato ..... 399/390
6,668,155 B1 * 12/2003 Hubble et al. ..... 399/406
2009/0003857 A1 * 1/2009 Kuramochi et al. ..... 399/45
2009/0297186 A1 * 12/2009 Fromm ..... 399/45
2010/0310264 A1 * 12/2010 Ishida et al. ..... 399/45
2011/0076035 A1 * 3/2011 Iwakawa ..... 399/16
2011/0194860 A1 * 8/2011 Peng et al. ..... 399/15
2011/0222927 A1 9/2011 Yamashina (Continued)

FOREIGN PATENT DOCUMENTS

JP 4-315188 11/1992
JP 10-160687 6/1998

(Continued)

OTHER PUBLICATIONS

U.S. Appl. No. 14/193,260, filed Feb. 28, 2014.

(Continued)

*Primary Examiner* — Clayton E Laballe
*Assistant Examiner* — Ruifeng Pu
(74) *Attorney, Agent, or Firm* — Oblon, McClelland, Maier & Neustadt, L.L.P.

(57) ABSTRACT

An image forming apparatus includes a conveyance passage unit, a fixing device, an optical sensor, a fixing condition adjuster, and a regulator. A recording medium passes through the conveyance passage unit. The fixing device fixes a toner image onto the recording medium. The optical sensor includes a light-emitting device and a light-receiving device to detect smoothness of the recording medium according to strength of light received. The fixing condition adjuster adjusts fixing conditions according to the smoothness detected. The regulator is disposed in the conveyance passage unit to regulate conveyance of the recording medium, such that at least a part of the recording medium passes through an irradiated area including an intersection that is determined by an emission angle of a first optical axis of light emitted by the light-emitting device and a reflection angle of a second optical axis of light received by the light-receiving device.

12 Claims, 8 Drawing Sheets

(56) References Cited

U.S. PATENT DOCUMENTS

| | | | | |
|---|---|---|---|---|
| 2012/0099908 | A1* | 4/2012 | Yamazoe | 399/316 |
| 2012/0243894 | A1* | 9/2012 | Umeda et al. | 399/68 |
| 2013/0070267 | A1* | 3/2013 | Kosasa | 358/1.9 |
| 2013/0164015 | A1* | 6/2013 | Kawai et al. | 399/69 |
| 2013/0194573 | A1 | 8/2013 | Ohba et al. | |
| 2013/0308966 | A1* | 11/2013 | Masuda et al. | 399/33 |
| 2014/0133894 | A1* | 5/2014 | Isogai | 399/400 |
| 2014/0270822 | A1* | 9/2014 | Yamashina et al. | 399/45 |
| 2015/0003883 | A1* | 1/2015 | Honda et al. | 399/406 |
| 2015/0078770 | A1* | 3/2015 | Yamano et al. | 399/45 |

FOREIGN PATENT DOCUMENTS

| | | |
|---|---|---|
| JP | 2002-340518 | 11/2002 |
| JP | 2006-062842 | 3/2006 |
| JP | 2009-128822 | 6/2009 |
| JP | 2009-271273 | 11/2009 |
| JP | 2011-046452 | 3/2011 |
| JP | 2012-006744 | 1/2012 |
| JP | 2012-194445 | 10/2012 |
| JP | 2012-208103 | 10/2012 |

OTHER PUBLICATIONS

U.S. Appl. No. 14/470,096, filed Aug. 27, 2014, Yamashina, et al.
U.S. Appl. No. 14/474,939, filed Sep. 2, 2014, Yamano, et al.
U.S. Appl. No. 14/470,096, filed Aug. 27, 2014.
U.S. Appl. No. 14/474,939, filed Sep. 2, 2014.

* cited by examiner

IMAGE FORMING APPARATUS WITH CONVEYANCE UNIT TO REGULATE PASSAGE OF RECORDING MEDIUM

CROSS-REFERENCE TO RELATED APPLICATIONS

This patent application is based on and claims priority pursuant to 35 U.S.C. §119(a) to Japanese Patent Application No. 2013-185358, filed on Sep. 6, 2013, in the Japan Patent Office, the entire disclosure of which is hereby incorporated by reference herein.

BACKGROUND

1. Technical Field

Embodiments of the present invention generally relate to an image forming apparatus capable of detecting surface smoothness of a recording medium.

2. Background Art

Various types of electrophotographic image forming apparatuses are known, including copiers, printers, facsimile machines, or multifunction machines having two or more of copying, printing, scanning, facsimile, plotter, and other capabilities. Such image forming apparatuses usually form an image on a recording medium according to image data. Specifically, in such image forming apparatuses, for example, a charger uniformly charges a surface of a photoconductor serving as an image carrier. An optical writer irradiates the surface of the photoconductor thus charged with a light beam to form an electrostatic latent image on the surface of the photoconductor according to the image data. A development device supplies toner to the electrostatic latent image thus formed to render the electrostatic latent image visible as a toner image. The toner image is then transferred, directly or indirectly via an intermediate transfer belt, onto a recording medium. Finally, a fixing device applies heat and pressure to the recording medium carrying the toner image to fix the toner image onto the recording medium. Thus, the image is formed on the recording medium.

SUMMARY

In one embodiment of the present invention, an improved image forming apparatus is described that includes a conveyance passage unit, a fixing device, an optical sensor, a fixing condition adjuster, and a regulator. A recording medium is conveyed through the conveyance passage unit. The fixing device fixes a toner image onto the recording medium conveyed through the conveyance passage unit. The optical sensor includes a light-emitting device to emit detection light toward the conveyance passage unit, and a light-receiving device to receive light reflected from a surface of the recording medium conveyed through the conveyance passage unit. The optical sensor detects smoothness of the recording medium according to strength of the light received. The fixing condition adjuster adjusts fixing conditions according to the smoothness detected by the optical sensor. The regulator is disposed in the conveyance passage unit to regulate conveyance of the recording medium, such that at least a part of the recording medium passes through a predetermined irradiated area including an intersection that is determined by a predetermined emission angle of a first optical axis of the detection light emitted by the light-emitting device and a predetermined reflection angle of a second optical axis of the reflected light received by the light-receiving device.

BRIEF DESCRIPTION OF THE DRAWINGS

A more complete appreciation of the disclosure and many of the attendant advantages thereof will be more readily obtained as the same becomes better understood by reference to the following detailed description of embodiments when considered in connection with the accompanying drawings, wherein.

Figure 1:
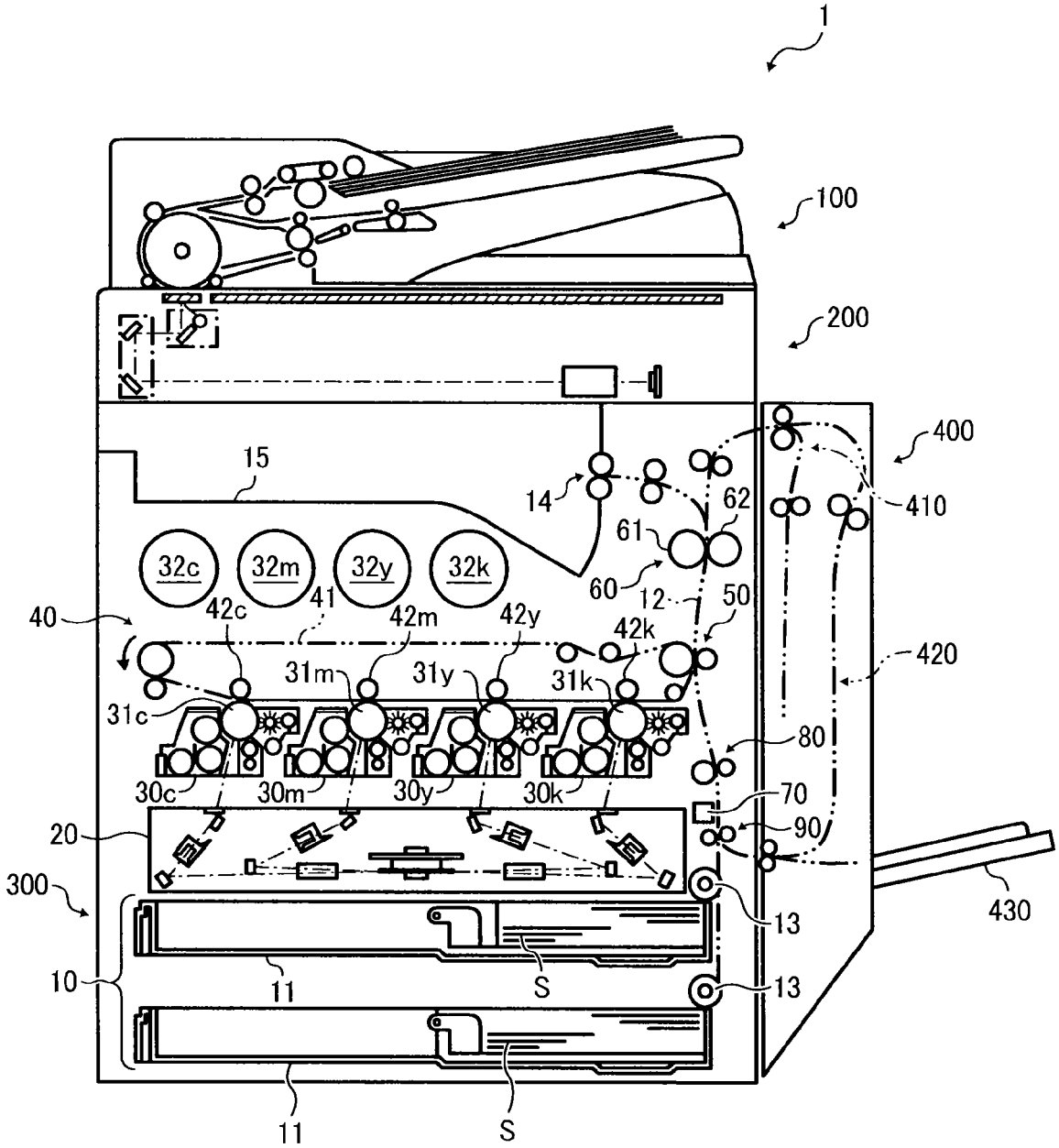
FIG. 1 is a schematic view of an image forming apparatus according to an embodiment of the present invention.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the invention and all of the components or elements described in the embodiments of the present invention are not necessarily indispensable to the present invention.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

It is to be noted that, in the following description, suffixes "y", "m", "c", and "k" denote colors yellow, magenta, cyan, and black, respectively. To simplify the description, these suffixes are omitted unless necessary.

Referring now to the drawings, wherein like reference numerals designate identical or corresponding parts throughout the several views, embodiments of the present invention are described below.

Initially with reference to FIG. 1, a description is given of an image forming apparatus 1 according to an embodiment of the present invention. FIG. 1 is a schematic view of the image forming apparatus 1.

According to the first embodiment, the image forming apparatus 1 is an electrophotographic image forming apparatus. As illustrated in FIG. 1, the image forming apparatus 1 includes, from the top, a document feeder 100, a scanner 200 serving as an image reader, a body 300, and a duplex unit 400 disposed beside the body 300.

The document feeder 100 is an auto document feeder (ADF) to automatically convey documents placed thereon one at a time starting from an uppermost document. The document feeder 100 is optional.

In addition, the document feeder 100 is hinged at the back to the image forming apparatus 1 and is openably closable with respect to the scanner 200. It is to be noted that a conventional document feeder having a known configuration can be used as the document feeder 100. Therefore, a detailed description thereof is herein omitted.

The scanner 200 scans an image of a document conveyed by the document feeder 100 or an image of a document placed on the scanner 200. Image data of the document scanned by the scanner 200 is outputted to the body 300. It is to be noted that a conventional scanner having a known configuration can be used as the scanner 200. Therefore, a detailed description thereof is herein omitted.

The body 300 contains a feed unit 10, an exposure device 20, imaging devices 30*c*, 30*m*, 30*y*, and 30*k*, an intermediate transfer device 40, a secondary transfer device 50, and a fixing device 60. The image forming apparatus 1 performs a series of image forming processes with those devices in that order.

The feed unit 10 is disposed in a lower portion of the body 300, and includes a plurality of trays 11 that can be drawn as needed. According to the first embodiment, two trays 11 are vertically disposed. Each of the trays 11 accommodates recording sheets S serving as recording media, and is provided with a feed roller 13 to feed the recording sheets S from the corresponding tray 11 one at a time starting from an uppermost recording sheet S. Each feed roller 13 is disposed above the corresponding tray 11, at a position downstream in a conveyance direction of the recording sheets S, that is, a direction in which the recording sheets S are conveyed.

The exposure device 20 is disposed above an uppermost one of the plurality of feed trays 11. The exposure device 20 irradiates the imaging devices 30*c*, 30*m*, 30*y*, and 30*k* with laser light according to the image data provided by the scanner 200, either of the document conveyed by the document feeder 100 or of the document placed on the scanner 200, or according to image data received via a personal computer or a telephone line.

The imaging devices 30*c*, 30*m*, 30*y*, and 30*k* form cyan, magenta, yellow and black toner images, respectively. The imaging devices 30*c*, 30*m*, 30*y*, and 30*k* are arranged side by side as illustrated in FIG. 1. The imaging devices 30*c*, 30*m*, 30*y*, and 30*k* include drum-shaped image carriers 31*c*, 31*m*, 31*y*, and 31*k*, respectively. Each of the image carriers 31*c*, 30*m*, 30*y*, and 30*k* is surrounded by various components and rotates in a clockwise direction in FIG. 1 to perform charging, development, transfer (or primary transfer), cleaning, and neutralizing processes in that order. The image carriers 31*c*, 30*m*, 30*y*, and 30*k* are supplied with toner as developers of the respective colors from toner bottles 32*c*, 32*m*, 32*y*, and 32*k*, respectively.

The intermediate transfer device 40 includes an endless intermediate transfer belt 41 entrained around a plurality of rollers and stretched almost horizontally. The intermediate transfer belt 41 rotates in a counterclockwise direction in FIG. 1. The intermediate transfer device 40 also includes primary transfer devices 42*c*, 42*m*, 42*y*, and 42*k*. The primary transfer devices 42*c*, 42*m*, 42*y*, and 42*k* faces the image carriers 31*c*, 30*m*, 30*y*, and 30*k*, respectively, via the intermediate transfer belt 41 to transfer toner images formed on the image carriers 31*c*, 30*m*, 30*y*, and 30*k* onto the intermediate transfer belt 41, respectively. Thus, a primary transfer image is formed thereon.

The secondary transfer device 50 is disposed along a conveyance passage 12 serving as a conveyance passage unit and secondarily transfers the primary transfer image from the intermediate transfer belt 41 onto the recording sheet S.

The fixing device 60 includes a heating member 61 and a pressing member 62 to apply heat and pressure to the recording sheet S carrying the toner image to fix the toner image on the recording sheet S. The heating member of the first embodiment is a belt disposed facing a front surface of the recording sheet S. The pressing member 62 is disposed facing a back surface of the recording sheet S and pressed against the heating member 61.

The body 300 further contains a discharge device 14 and a discharge tray 15. The recording sheet S carrying the fixed toner image is conveyed from the fixing device 60 to the discharge device 14, which discharges the recording sheet S onto the discharge tray 15.

The duplex unit 400 is used to form an image on each side of the recording sheet S. The duplex unit 400 includes a switchback device 410 and a reverse device 420. The duplex unit 400 also includes a bypass tray 430 that supplies recording sheets placed thereon to the body 300, apart from the trays 11.

Upon duplex printing, the recording sheet S carrying the fixed toner image on one side is conveyed to the duplex unit 400, in which the switchback device 410 switches an upstream end and a downstream end of the recording sheet S in the conveyance direction of the recording sheet S, and conveys the recording sheet S to the reverse device 420. The reverse device 420 supplies the recording sheet S to the conveyance passage 12, specifically, to a position around an upstream end of the conveyance passage 12 in the conveyance direction of the recording sheet S, via a passage through which a recording sheet is supplied from the bypass tray 430 to the body 300.

A sensor 70 is an optical sensor disposed along the conveyance passage 12, between the uppermost one of the feed rollers 13 and the secondary transfer device 50. The sensor 70 detects medium data of the recording sheet S from an upstream side in the conveyance direction of the recording sheet S. Further, a registration device 80 is disposed along the conveyance passage 12, downstream from the sensor 70 in the conveyance direction of the recording sheet S. The registration device 80 adjusts the timing of conveyance of the recording sheet S. Furthermore, a pair of conveyance rollers 90 is disposed along the conveyance passage 12, upstream from the sensor 70 in the conveyance direction of the recording sheet S. The pair of conveyance rollers 90 conveys the recording sheet S. According to the first embodiment, the image forming apparatus 1 includes a detection and regulation portion 99 along the conveyance passage 12. The detection and regulation portion 99 includes the sensor 70, the registration device 80, and the pair of conveyance rollers 90 described above. The function of the sensor 70 is described below by way of reference to conventional examples.

Usually, in image forming apparatuses, fixing conditions such as heat and pressure to fix a toner image onto a recording medium or a conveying speed of the recording medium are taken into account. In particular, such fixing conditions are determined specifically for each type of recording medium to form a high-quality image on the recording medium because the image quality is significantly influenced by such factors as the material, thickness, humidity, smoothness, and coating (if any) of the recording medium. The surface smoothness of the recording medium can be ascertained by, e.g., time (in seconds) taken for a certain amount of air to flow between the recording medium and a testing board adhering to the recording medium.

The smoothness and fixing quality of the recording medium are correlated because the surface roughness of the recording medium, in particular the fixing rate of toner in recessed portions of the recording medium changes. Accordingly, if an image is fixed onto the recording medium under fixing conditions neglecting the surface smoothness of the recording medium in use, a high-quality image may not be obtained and, in some cases, fixing errors may occur, generating an unusual image on the recording medium.

Meanwhile, with recent progress in the image forming apparatuses as well as diversified expression, there are now hundreds of different types of recording media. Each type of recording medium has a variety of brands with, e.g., different basis weights and thickness. Therefore, to form a high-quality image, fixing conditions are determined in detail according to, e.g., the types and brands of recording media.

For example, there are increasing numbers of types of recording media such as plain paper, coated paper such as gross coated paper, mat coated paper, and art coated paper, overhead projector (OHP) sheets, and special paper such as a sheet of paper prepared by embossing a surface thereof. It is to be noted that the above-described recording medium is, e.g., a recording sheet. However, there are a number of recording media other than recording sheets.

In the image forming apparatuses, generally, the fixing conditions are determined according to the basis weight of the recording medium by which the recording medium is classified. For example, paper having a basis weight of about 60 $g/m^2$ to about 90 $g/m^2$ is classified as plain paper. Paper having a basis weight of about 91 $g/m^2$ to about 105 $g/m^2$ is classified as medium thick paper. Paper having a basis weight of about 106 $g/m^2$ to about 200 $g/m^2$ is classified as thick paper. The fixing temperature, pressing force, and conveying speed of the recording medium are determined according to these classifications.

Generally, the basis weight of recording media is listed on the package so that users can easily ascertain the basis weight data. If an image forming apparatus is a copier or has a copying function, the image forming apparatus acknowledges the basis weight data when a user operates an operation panel of the image forming apparatus to set the basis weight data therethrough. On the other hand, if an image forming apparatus is a printer or has a printing function, the image forming apparatus acknowledges the basis weight data when a user sets the basis weight data through a printer driver displayed by a personal computer to include the basis weight data in image data to be outputted.

As described above, generally, the users set the basis weight data by themselves, which may be troublesome for them to appropriately operate the image forming apparatus. In addition, if the users erroneously set the basis weight data, an intended high-quality image may not be obtained.

Accordingly, some image forming apparatuses incorporate a sensor to detect the thickness of recording media to automatically set the fixing conditions for the thickness of the recording media to form an image thereon.

On the other hand, the smoothness of recording media is not usually listed on the package, which makes it difficult for the users to know the smoothness data. For this reason, the users may use, e.g., a smoothness sensor to automatically obtain the smoothness of the recording media.

As described above, the smoothness and the fixing conditions are correlated. However, it is difficult to detect the smoothness in a short period of time because the smoothness represents the time taken for a certain amount of air to flow between a recording medium and a testing board.

Accordingly, smoothness sensors may be used to measure the surface roughness or an amount of reflected light as alternative characteristics to the smoothness because such surface roughness or an amount of reflected light and the smoothness are correlated.

For example, a sensor detects the smoothness of a recording medium without contacting the recording medium, according to an amount of light reflected from a surface of the recording medium conveyed through a conveyance passage when a light-emitting device such as a light-emitting diode (LED) emits detection light toward the conveyance passage.

If the smoothness of the recording medium is relatively low, in other words, if the surface of the recording medium is relatively rough, the heat and pressure hardly apply to the recessed portions of the surface of the recording medium during fixing operation. By contrast, if the smoothness of the recording medium is relatively high, that is, if the surface of the recording medium is relatively smooth, the heat and pressure easily apply to the recessed portions of the surface of the recording medium during fixing operation. In short, if images are fixed onto recording media having different degrees of smoothness under the same fixing conditions, the fixing quality may vary among the recording media. Thus, the smoothness and fixing quality are correlated.

Taking into account such a situation, generally, a fixing temperature is determined to secure a sufficient fixing strength of a recording medium having a relatively low smoothness, whereas a relatively large amount of heat is applied to a recording medium having a relatively high smoothness, wasting power consumption.

Accordingly, the smoothness sensor described above is useful as the fixing temperature can be determined according to data provided by the smoothness sensor. For example, if the smoothness sensor detects a high smoothness, the fixing temperature is decreased to enhance energy efficiency. By contrast, if the smoothness sensor detects a low smoothness, the fixing temperature is increased to secure the fixing strength.

Therefore, detecting the smoothness more accurately contributes to a greater energy efficiency and securing of an appropriate fixing strength.

To accurately detect the smoothness of the recording medium, for example, light is directed to the recording medium at a low angle of incidence and specularly reflected light is detected.

In such a case, an imaging device may receive the reflected light to produce an image, and the image is analyzed to calculate the smoothness. However, the image analysis takes time, and thus is against recent progress in high-speed machines.

Generally, the conveyance passage has a certain height in a thickness direction of the recording media taking into account a variety of thicknesses of the recording media to prevent jamming of the recording media being conveyed.

In other words, the conveyance passage is higher than the thickness of recording medium, even if the conveyance passage is curved, causing malfunctions such as a flip of recording medium being conveyed. In addition, when such an imaging device is used, a desired imaging result may not be obtained unless the imaging device comes into focus. In other words, an accurate and stable smoothness may not be obtained.

According to an embodiment of the present invention, an image forming apparatus includes a conveyance passage unit, a fixing device, an optical sensor, a fixing condition adjuster, and a regulator. A recording medium is conveyed through the conveyance passage unit. The fixing device fixes a toner image onto the recording medium conveyed through the conveyance passage unit. The optical sensor includes a light-emitting device to emit detection light toward the conveyance passage unit, and a light-receiving device to receive light reflected from a surface of the recording medium conveyed through the conveyance passage unit. The optical sensor detects smoothness of the recording medium according to strength of the light received. The fixing condition adjuster adjusts fixing conditions according to the smoothness detected by the optical sensor. The regulator is disposed in the conveyance passage unit to regulate conveyance of the recording medium, such that at least a part of the recording medium passes through a predetermined irradiated area including an intersection. The intersection is determined by a predetermined emission angle of a first optical axis of the detection light emitted by the light-emitting device and a predetermined reflection angle of a second optical axis of the reflected light received by the light-receiving device.

Accordingly, the conveyance of the recording medium is regulated to contribute to optimization of a position of the recording medium at which the recording medium faces the optical sensor serving as a smoothness sensor while being conveyed, and to further contribute to enhancement in detection accuracy and stabilization of detection results.

Figure 2:
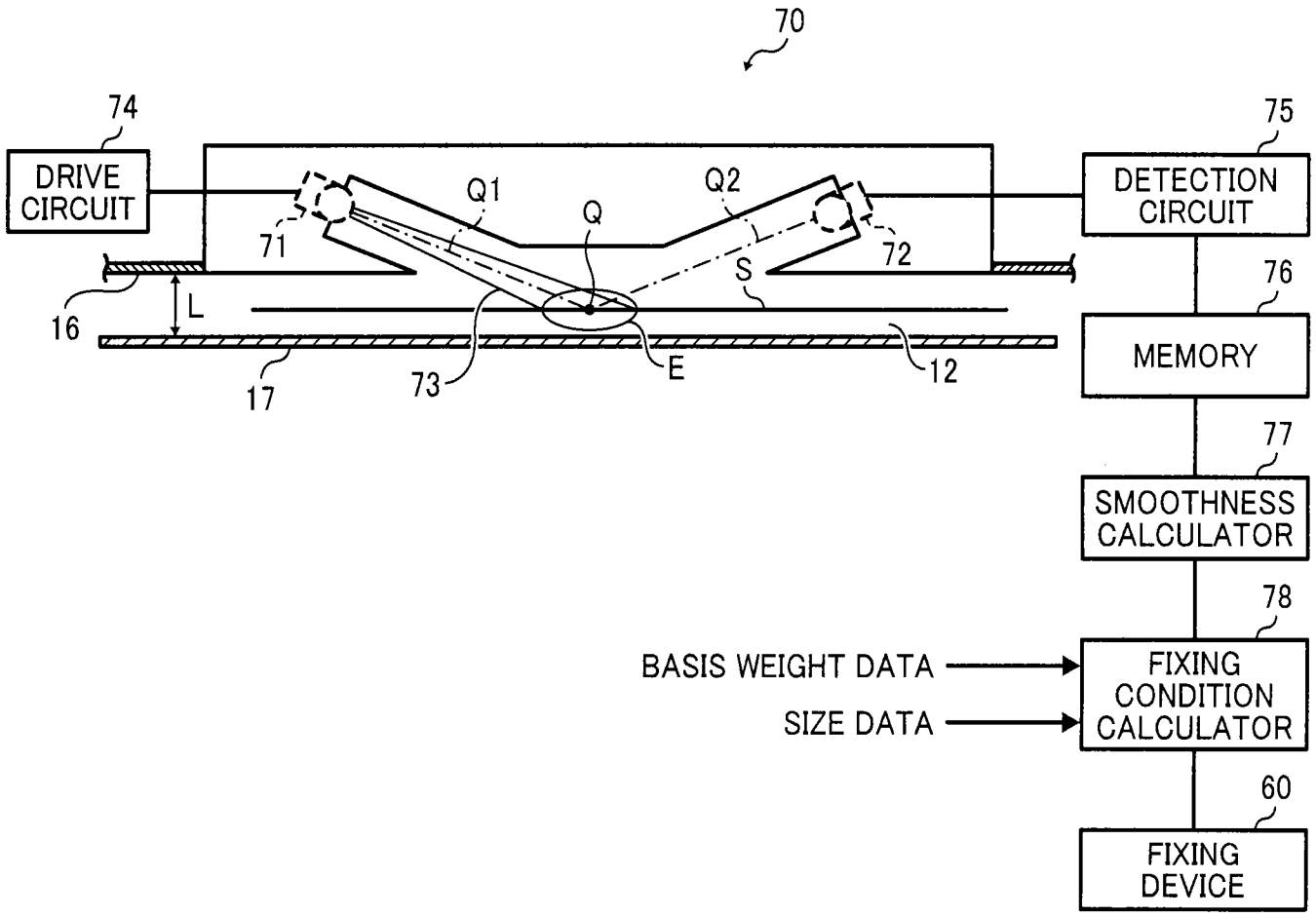
FIG. 2 is a sectional view of a detection portion of the image forming apparatus of FIG. 1.

Referring now to FIG. 2, a description is given of the conveyance passage 12 according to the first embodiment.

FIG. 2 is a sectional view of a detection portion of the image forming apparatus of FIG. 1.

As illustrated in FIG. 2, the conveyance passage 12 between the registration device 80 and the pair of conveyance rollers 90 is constructed of, e.g., opposed conveyance guide boards 16 and 17 disposed opposite and apart from each other. The conveyance guide boards 16 and 17 define a conveyance height L along a thick direction of the recording sheet S, which is the vertical direction in FIG. 2. In other words, the conveyance guide boards 16 and 17 define the conveyance height L by an interval therebetween, which is greater than the thickness of the recording sheet S. The conveyance guide boards 16 and 17 also define the conveyance direction of the recording sheet S, which is a depth direction perpendicular to a sheet face of FIG. 2. It is to be noted that the registration device 80 is well known and therefore, a detailed description thereof is herein omitted.

The sensor 70 is disposed at the conveyance guide board 16 or the conveyance guide board 17. According to the first embodiment, for example, the sensor 70 is disposed at the conveyance guide board 16 that is located inward from the conveyance guide board 17 in the body 300. The sensor 70 includes a light-emitting device 71 serving as a light emitter, and a light-receiving device 72 serving as a light receiver to detect the smoothness of the recording sheet S. The light-emitting device 71 emits detection light 73, which is diffusion light about an optical axis Q1. The detection light 73 is reflected from the surface of the recording sheet S. The light-receiving device 72 receives light reflected from the surface of the recording sheet S, which is indicated as an optical axis Q2 in FIG. 2, when the recording sheet S passes through the conveyance passage 12.

The light-emitting device 71 is, e.g., a laser diode (LD) or a light-emitting diode (LED). A drive circuit 74 supplies electric power to the light-emitting device 71 and controls its firing, for example. The light-receiving device 72 is a photodetector such as a photodiode or a phototransistor. A detection circuit 75 amplifies the reflected light (Q2) received by the light-receiving device 72 as a detection current and converts it from analogue to digital forms. A memory 76 stores the current thus converted for each recording sheet S meeting the sensor 70. It is to be noted that the memory 76 is a device such as a hard disk drive incorporated in the body 300 as standard equipment.

The reflected light (Q2), which is reflected in an irradiated area E of the recording sheet S, includes scattering light and specularly reflected light. A plurality of light-emitting devices 71 and drive circuits 74, or a plurality of light-receiving devices 72 and detection circuits 75 may be provided to use the scatter component to detect a surface nature.

A smoothness calculator 77 converts the currents stored in the memory 76 into voltages, equalizes the voltages per recording sheet S, and converts the equalized voltages into smoothness. Thus, the smoothness calculator 77 calculates the smoothness for each recording sheet S. The smoothness thus calculated is outputted to a fixing condition calculator 78 serving as a fixing condition adjuster. The fixing condition calculator 78 calculates fixing conditions such as a fixing temperature, a pressing force, and a conveying speed, taking into account the basis weight data and the size data of the recording sheet S in addition to the smoothness inputted from the smoothness calculator 77. The fixing conditions thus calculated are outputted to the fixing device 60.

Figure 3:
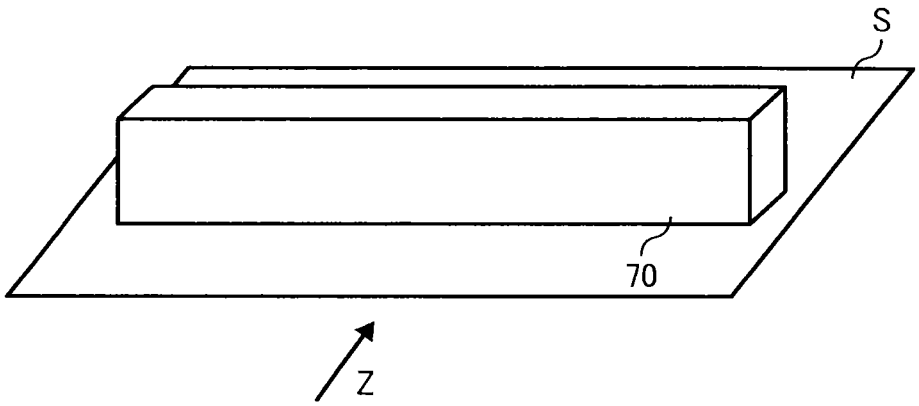
FIG. 3 is a diagram illustrating a relation between a direction in which a recording sheet is conveyed and a direction in which a sensor is oriented in the detection portion of FIG. 2.

FIG. 3 illustrates how the sensor 70 is oriented with respect to the conveyance direction Z. According to the first embodiment, the sensor 70 includes the optical axes Q1 and Q2 perpendicular to a direction in which the recording sheet S is conveyed, which is, e.g., a direction indicated by arrow Z (hereinafter referred to as conveyance direction Z) in FIG. 3. In other words, when the recording sheet S is conveyed in the body 300 in a vertical direction, but not limited to a perpendicular direction, the optical axes Q1 and Q2 are located within an identical surface (e.g., a horizontal surface) perpendicular to the conveyance direction Z.

As described above, the sensor 70 is located upstream from the registration device 80 in the conveyance direction. It is to be noted that an interval between the sensor 70 and the registration device 80 allows the sensor 70 to detect the smoothness of the recording sheet S having a minimum permissible size set for the image forming apparatus 1 while the registration device 80 temporarily stops conveying the recording sheet S when the recording sheet S reaches the registration device 80 and adjusts the timing of conveyance of the recording sheet S.

The fixing condition calculator 78 calculates a fixing temperature at which an image can be appropriately fixed onto a recording sheet S, based on a typical smoothness of, e.g., about 40 seconds as a predetermined smoothness. It is to be noted that such an appropriate fixing temperature determined for a recording sheet having the predetermined smoothness is hereinafter referred to as a normal fixing temperature.

When the sensor 70 detects an unknown smoothness, which is a smoothness beyond a predetermined range, the fixing condition calculator 78 adjusts the fixing conditions including the fixing temperature, taking into account the smoothness thus calculated by the sensor 70. For example, if the recording sheet S has a relatively high smoothness with a relatively low surface roughness, an image can be fixed thereon with a relatively small amount of heat. Accordingly, the fixing condition calculator 78 adjusts the fixing temperature to a lower temperature than the normal fixing temperature. By contrast, if the recording sheet S has a relatively low smoothness with a relatively high surface roughness, the fixing condition calculator 78 adjusts the fixing temperature to a higher temperature than the normal fixing temperature to secure a sufficient amount of heat.

A description is now given of an example of detection of the smoothness of the recording sheet S.

Figure 4:
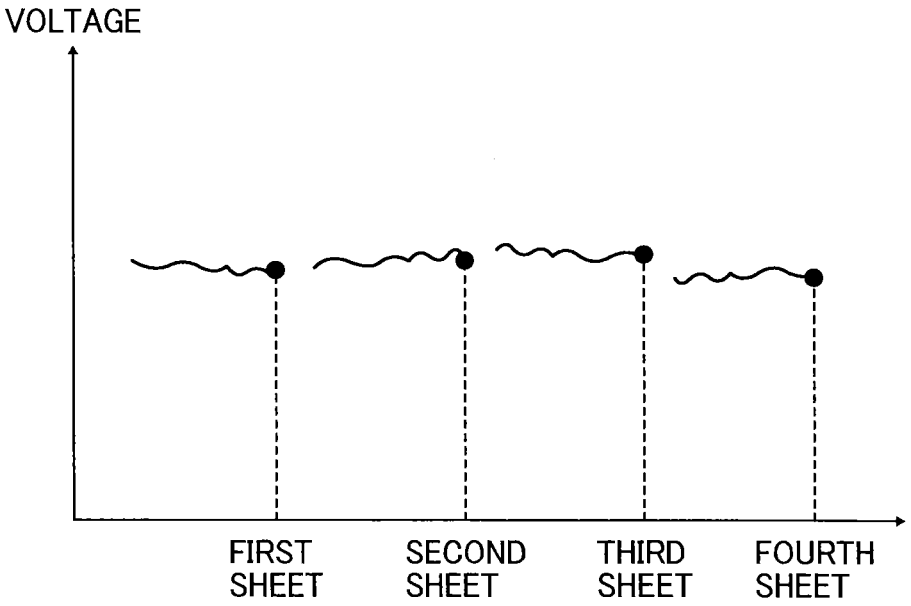
FIG. 4 is an exemplary graph of voltage waves of four recording sheets to calculate smoothness for each recording sheet.

As described above, the recording sheet S is conveyed through the conveyance passage 12, which is constructed of the conveyance guide boards 16 and 17 separated from each other by the conveyance height L that is greater than the recording sheet S. Accordingly, even if the same brand and type of recording sheets S are conveyed, the sensor 70 may detect different voltage fluctuations among, e.g., first through fourth recording sheets as the first through fourth recording sheets S may move differently. FIG. 4 illustrates such different voltage fluctuations as voltage waves, with dots indicating equalized voltages. Accordingly, even though the voltage fluctuation thus detected is equalized and converted into smoothness for each of the first through fourth recording sheets S, the smoothness thus converted varies among the first through fourth recording sheets S.

The same brand and type of recording sheets S are generally supposed to have substantially the same smoothness. However, in a survey of variation in smoothness of over 100 brands of recording sheets S selected at random, the same brand of 20 recording sheets S had a variation in smoothness of about 8% at most from an average smoothness.

When the sensor 70 detects the smoothness of each recording sheet S and the fixing temperature is adjusted according to the smoothness thus detected as described above, fixing failures are unlikely to occur even if the smoothness varies among the recording sheets S.

However, the fixing temperature may be adjusted taking into account the above-described variation in smoothness if the fixing temperature cannot be adjusted for each recording sheet S due to, e.g., time constraints. Such time constraints may be attributed to high-speed image forming processing. For example, heat response of the fixing device 60 may be delayed in the high-speed image forming processing.

One approach to adjusting the fixing temperature taking into account the variation in smoothness is determining the fixing temperature based on the smoothness of the first recording sheet S with a margin of safety. Specifically, if the first recording sheet S has a smoothness of, e.g., 80 seconds, the fixing temperature may be determined higher than a fixing temperature for the smoothness of 80 seconds to secure a sufficient fixing temperature for a subsequent recording sheet S that may have a lower smoothness than the first recording sheet S by, e.g., 6.4 seconds (8% of 80 seconds). It is to be noted that the 8% is a margin of safety of the smoothness of the first recording sheet S. The margin of safety of 8% is regarded as a maximum margin of safety from the survey result described above, in which the variation in smoothness was 8% at most from the average smoothness.

As described above, the fixing temperature may be determined with the margin of safety to prevent fixing failures when it is difficult to detect the smoothness for each recording sheet S and adjust the fixing temperature according to the smoothness thus detected.

Referring back to FIG. 2, a predetermined emission angle of the optical axis Q1 of the detection light 73 emitted by the light-emitting device 71 is basically the same as a predetermined reflection angle of the optical axis Q2 of the reflected light received by the light-receiving device 72. In the present embodiment, the predetermined emission angle and the predetermined reflection angle are set within a range from about 10° to about 14°, for example. In addition, the conveyance passage 12 regulates conveyance of the recording sheet S, such that at least a part of the surface of the recording sheet S passes through a predetermined irradiated area E including an intersection Q determined by the predetermined emission angle of the optical axis Q1 and the predetermined reflection angle of the optical axis Q2.

It is to be noted that FIG. 2 illustrates the irradiated area E in the depth direction along the conveyance height L with the intersection Q located on the surface, more specifically, a hypothetical flat surface of the recording sheet S when stably conveyed. The light-receiving device 72 detects the light reflected from the surface of the recording sheet S when stably conveyed, along a predetermined line in a direction in which the flat surface is oriented. Alternatively, the irradiated area E may be a three-dimensional area defined by adding the depth to the two-dimensional area within the hypothetical flat surface of the recording sheet S when stably conveyed, because the sensor 70 has a certain sensitivity in the depth direction along the conveyance height L.

Figure 5:
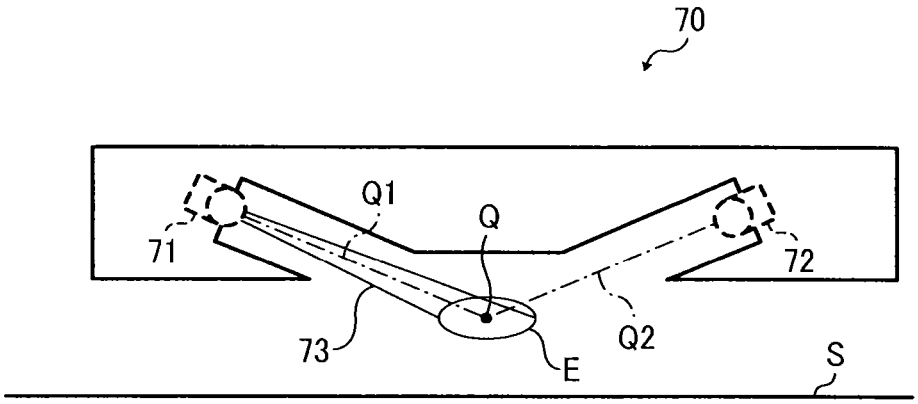
FIG. 5 is a sectional view of the sensor with the recording sheet, illustrating a first comparative example of conveyance of the recording sheet in which the recording sheet is conveyed apart from an intersection of the sensor.
Figure 6:
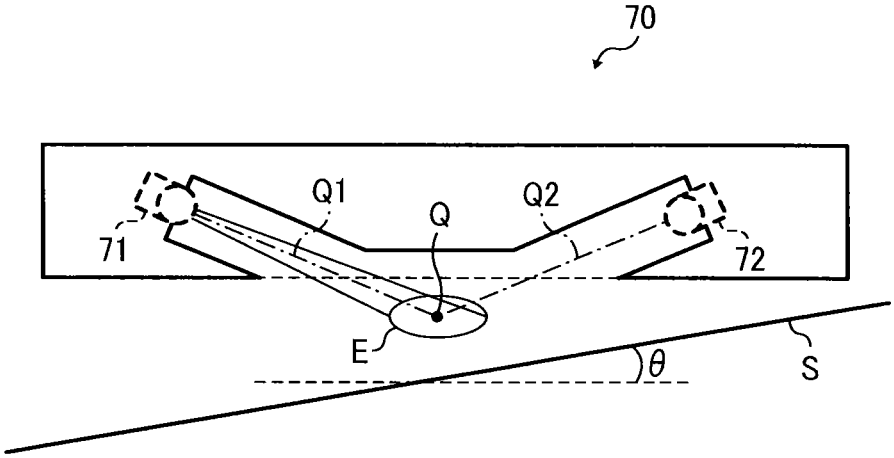
FIG. 6 is a sectional view of the sensor with the recording sheet, illustrating a second example of conveyance of the recording sheet in which the recording sheet is skewed at an angle and conveyed apart from the intersection of the sensor.

Variations in smoothness of the recording sheets S may be attributed to, e.g., first and second comparative examples of conveyance of the recording sheets S illustrated in FIGS. 5 and 6, respectively. FIG. 5 is a sectional view of the sensor 70 with the recording sheet S, illustrating the first comparative example in which the recording sheet S is stably conveyed, but apart from the intersection Q without passing the irradiated area E. FIG. 6 illustrates the second example in which the recording sheet S is skewed at an angle θ and conveyed apart from the intersection Q without passing the irradiated area E.

Figure 7:
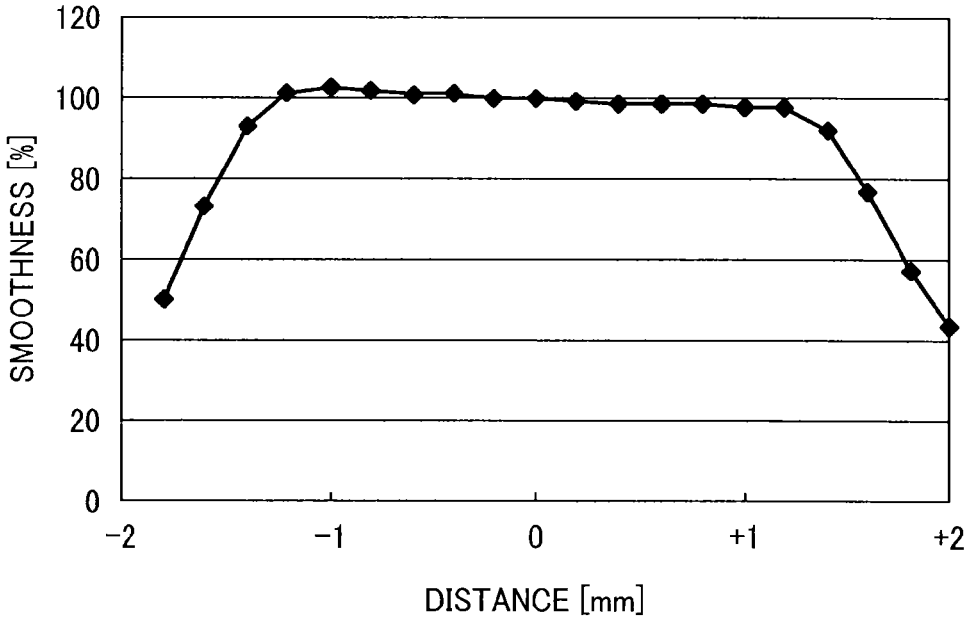
FIG. 7 is a graph of variations in detected smoothness of recording sheets when the recording sheets are conveyed apart from the intersection of the sensor.
Figure 8:
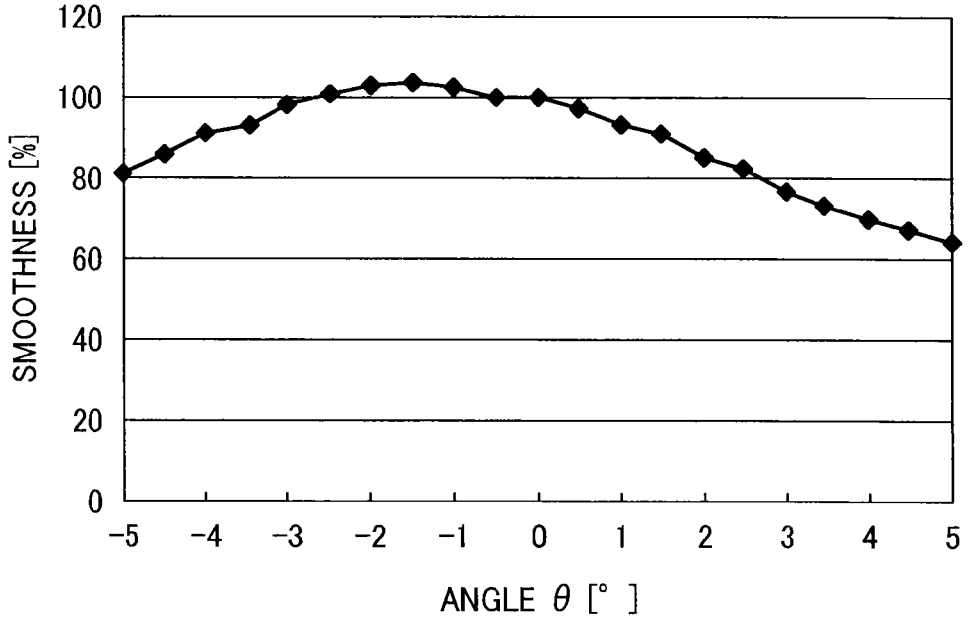
FIG. 8 is a graph of variations in detected smoothness of recording sheets when the recording sheets are skewed at different angles and conveyed apart from the intersection of the sensor.

FIGS. 7 and 8 are graphs of variations in smoothness of recording sheets S detected in an experiment. Specifically, FIG. 7 illustrates the smoothness of the recording sheets S calculated by the smoothness calculator 77 when the recording sheets S were conveyed apart from the intersection Q. In particular, FIG. 7 illustrates decrease in the smoothness of the recording sheets S when the recording sheets S were conveyed apart from the intersection Q as in the first comparative example illustrated in FIG. 5. It is to be noted that the smoothness of a recording sheet S passing through the intersection Q was 100%. Similarly, FIG. 8 illustrates the smoothness of the recording sheets S calculated by the smoothness calculator 77 when the recording sheets S were skewed and conveyed apart from the intersection Q at angles θ. In particular, FIG. 8 illustrates decrease in the smoothness of the recording sheets S when the recording sheets S were skewed and conveyed apart from the intersection Q at angles θ as in the second comparative example illustrated in FIG. 6. It is to be noted that the smoothness of the recording sheet S passing through the intersection Q at an angle θ=0° was 100%.

As illustrated in FIG. 7, the sensor 70 had a relatively high sensitivity within a range of about ±1 mm from the intersection Q. By contrast, the sensitivity of the sensor 70 decreased outside the above-described range, causing variation in calculated smoothness.

As illustrated in FIG. 8, changes in the angle θ at which the recording sheet S were conveyed caused variations in calculated smoothness. Specifically, a greater angle θ in the same direction as that illustrated in FIG. 6 caused greater variations in calculated smoothness.

As is clear from the results described above, although the sensor 70 has a relatively high sensitivity with respect to the angle θ, the conveyance of the recording sheet S beyond a predetermined range of distance and angle hampers detection of correct smoothness.

The conveyance of the recording sheet S is affected particularly by such factors as the stiffness of the recording sheet S, the conveyance height L defined by the conveyance guide boards 16 and 17, and the angle at which the conveyance guide boards 16 and 17 are assembled (i.e., inclination of the conveyance passage 12).

With respect to the stiffness that may affect the conveyance of the recording sheets S, the recording sheets S having different degrees of stiffness may be deformed differently while moving. However, such stiffness of the recording sheets S cannot be determined by a designer while the type of the recording sheets S can be selected by a user.

On the other hand, the designer can determine the conveyance height L defined by the conveyance guide boards 16 and 17, and the angle at which the conveyance guide boards 16 and 17 are assembled (i.e., inclination of the conveyance passage 12).

A description is now given of these factors, namely, the conveyance height L and the inclination of the conveyance passage 12.

Figure 9:
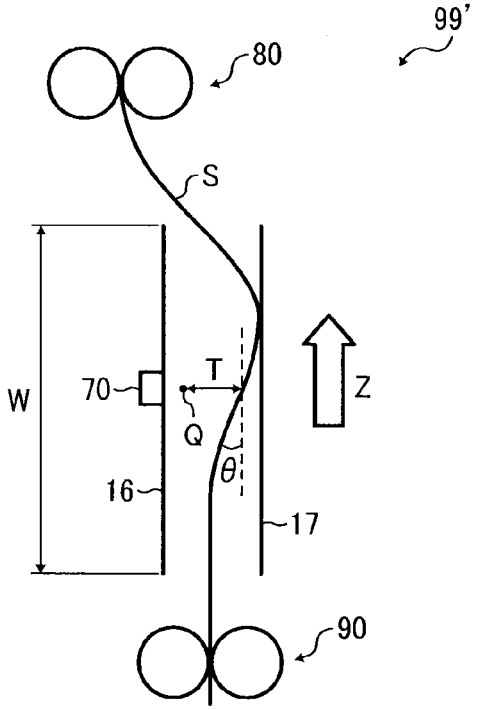
FIG. 9 is a sectional view of a comparative detection and regulation portion illustrating a third comparative example of conveyance of the recording sheet conveyed apart from the intersection of the sensor.

FIG. 9 is a sectional view of a comparative detection and regulation portion 99' illustrating a third comparative example of conveyance of the recording sheet S diverging from the intersection Q of the sensor 70. In FIG. 9, the recording sheet S is vertically conveyed in the conveyance direction Z. The sensor 70 is disposed at substantially the center of a detection section W, which is a length of the conveyance guide boards 16 and 17 in the conveyance direction Z. The intersection Q of the sensor 70 is located on the conveyance height L. In the third comparative example, the recording sheet S passes through the detection section W while meandering between the registration device 80 and the pair of conveyance rollers 90. In such a case, the sensor 70 detects the smoothness of the recording sheet S that is apart from the intersection Q by a height T along the depth direction and skewed at the angle θ.

The conveyance of the recording sheet S depends on a space through which the recording sheet S passes. In other words, the conveyance of the recording sheet S depends on a manner in which the conveyance guide boards 16 and 17 are assembled (i.e., component tolerance).

However, reducing varied manners in which the conveyance guide boards 16 and 17 are assembled (i.e., component tolerance) may increase component costs. Accordingly, the conveyance of the recording sheets S is stabilized preferably in ways other than simply decreasing the component tolerance.

The fixing temperature is determined taking into account the variation in smoothness of the recording sheets S by using an average of reflected light detected by the sensor 70 linearly, not as dots. Accordingly, if the sensor 70 detects the smoothness of the recording sheets S unstably conveyed, the detected data may show a greater variation in smoothness.

In addition, compact image forming apparatuses have a configuration in which the recording sheets S are conveyed vertically and upwardly. The conveyance of the recording sheets S is likely to become unstable due to gravity in such a configuration, compared to a configuration in which recording sheets are conveyed horizontally.

To regulate the conveyance of the recording sheets S, a regulator may be used to constantly press the recording sheets S. However, such a regulator may generate paper powder and affects the operation of the fixing device 60. In addition, such a regulator may cause conveyance failures including jamming of the recording sheets S.

Accordingly, the conveyance of the recording sheets S is preferably conducted within a predetermined range to correctly detect the smoothness of the recording sheets S.

Figure 10:
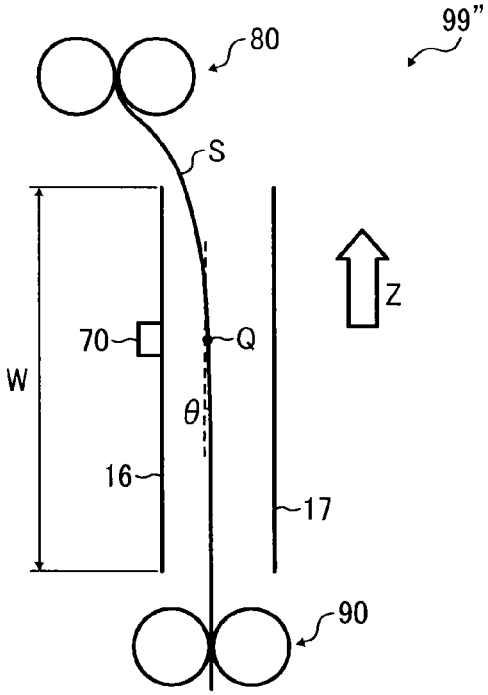
FIG. 10 is a sectional view of another comparative detection and regulation portion illustrating a fourth comparative example of conveyance of the recording sheet S conforming to the intersection of the sensor.

FIG. 10 is a sectional view of a comparative detection and regulation portion 99" illustrating a fourth comparative example of conveyance of the recording sheet S. Preferably, as illustrated in FIG. 10, a part of the recording sheet S conforms to the intersection Q and the angle θ is nearly zero when the registration device 80 temporarily stops conveying the recording sheet S, resulting in deformation of the recording sheet S.

However, as described above, the recording sheets S may be deformed differently due to different degrees of stiffness. Therefore, it may be difficult to regulate the recording sheets S having different degrees of stiffness in the same manner as if the recording sheets S were floating within a range of the conveyance height L through the conveyance passage 12.

According to the first embodiment, attention is focused on a temporary conveyance stop of the recording sheet S by a pair of rollers that sandwiches and conveys the recoding sheet S, and particularly by the registration device 80 that regulates a skew of the recording sheet S. The registration device 80 temporarily stops conveying the recording sheet S for a predetermined period of time longer than a typical pair of rollers that sandwiches and conveys the recoding sheet S.

Accordingly, it is relatively easy to control an amount of conveyance of the recording sheets S, that is, a length of the recording sheets S between the registration device 80 and the pair of conveyance rollers 90 in the same manner, regardless of the stiffness thereof. The conveyance of the recording sheets S can be regulated when the sensor 70 detects the recording sheets S, by regulating deformation of the recording sheets S in the same manner between the registration device 80 and the pair of conveyance rollers 90, particularly in the detection section W.

Figure 11:
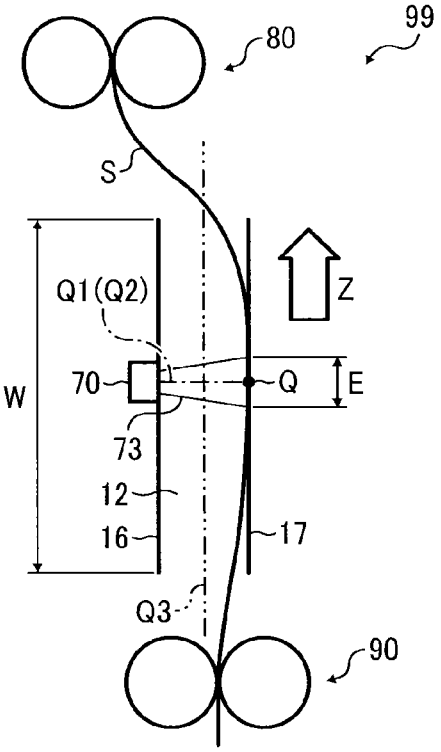
FIG. 11 is a sectional view of a detection and regulation portion according to a first embodiment illustrating a trough of the recording sheet is in an irradiated range including the intersection of the sensor.

FIG. 11 is a sectional view of the detection and regulation portion 99 illustrating an example of regulating the conveyance of the recording sheet S when the sensor 70 detects the recording sheet S.

In FIG. 11, the sensor 70 is disposed within the detection section W. As described above, the intersection Q is determined by the predetermined emission angle of the optical axis Q1 of the detection light 73 and the predetermined reflection angle of the optical axis Q2 of the reflected light. The intersection Q is positioned substantially on an inner surface side of the conveyance guide board 17. Accordingly, the predetermined irradiated area E of the detection light 73 including the intersection Q is substantially a flat area in the inner surface of the conveyance guide board 17, thereby obviating the need to take into account the depth.

In the present embodiment, the registration device 80 acts as a regulator that forms a conveyance nip at a position shifted to one side of a reference conveyance axis Q3 in a direction of the conveyance height L. The reference conveyance axis Q3 passes through a center of the conveyance guide boards 16 and 17 in the direction of the conveyance height L, extending in the conveyance direction Z.

Accordingly, the registration device 80 serves as a regulator to regulate the conveyance of the recording sheet S, such that at least a part of the surface of the recording sheet S passes through the irradiated area E including the intersection Q located in a flat surface substantially conforming to the inner surface of the conveyance guide board 17.

Specifically, the registration device 80 regulates the conveyance of the recording sheet S, such that a trough extending in a direction that intersects the conveyance direction Z (i.e., a depth direction of a sheet face of FIG. 11) is located in the irradiated area E.

More specifically, the registration device 80 is disposed such that the registration device 80 has a nip between the rollers thereof at a position shifted from the reference conveyance axis Q3 inward in the body 300. The registration device 80 regulates the recording sheet S located between the registration device 80 and the pair of conveyance rollers 90, such that the back surface of the recording sheet S, onto which a toner image is not secondarily transferred, partly contacts the conveyance guide board 17, which is located at a position shifted from the reference conveyance axis Q3 outward in the body 300.

Accordingly, the trough on the front surface of the recording sheet S can be located in a contact part with the conveyance guide board 17. It is to be noted that a nip position of the pair of conveyance rollers 90 depends on the distance between the registration device 80 and the pair of conveyance rollers 90. For example, the nip position of the pair of conveyance rollers 90 may be adjusted between the reference conveyance axis Q3 and the conveyance guide board 17 to relatively regulate the conveyance of the recording sheet S to move the trough close to the intersection Q.

The distance between the registration device 80 and the reference conveyance axis Q3 as well as the distance between the pair of conveyance rollers 90 and the reference conveyance axis Q3 may depend on layouts of other components in the body 300. In such a case, the position of the sensor 70 may be adjusted within the detection section W, such that the intersection Q is positioned on the trough.

Since users can identify and specify the stiffness, that is, thickness of the recording sheets S, the position of the registration device 80, the pair of conveyance rollers 90, or the sensor 70 may be automatically adjusted in response to an input of the thickness data.

As described above, according to the first embodiment, the image forming apparatus 1 includes the conveyance passage 12, the fixing device 60, the sensor 70, the fixing condition calculator 78, and the registration device 80. The recording sheet S is conveyed through the conveyance passage 12. The fixing device 60 fixes a toner image onto the recording sheet S conveyed through the conveyance passage 12. The sensor 70 includes the light-emitting device 71 and the light-receiving device 72. The light-emitting device 71 emits the detection light 73 toward the conveyance passage 12. The light-receiving device 72 receives the light reflected from the surface of the recording sheet S conveyed through the conveyance passage 12. The sensor 70 detects the smoothness of the recording sheet S according to strength of the light received. The fixing condition calculator 78 adjusts the fixing conditions according to the smoothness detected by the sensor 70. The registration device 80 is disposed in the conveyance passage 12, and acts as a regulator to regulate the conveyance of the recording sheet S, such that at least a part of the recording sheet S passes through the predetermined irradiated area E including the intersection Q. The intersection Q is determined by the predetermined emission angle of the optical axis Q1 of the detection light 73 that is emitted by the light-emitting device 71 and the predetermined reflection angle of the optical axis Q2 of the reflected light received by the light-receiving device 72.

Accordingly, the registration device 80 regulates the conveyance of the recording sheet S that is conveyed to the registration device 80, such that the trough of the recording sheet S extending in the direction that intersects the conveyance direction Z is positioned in the irradiated area E. As a result, the sensor 70 easily detects the smoothness of the recording sheet S, even if the sensor 70 has a relatively low sensitivity in the depth direction. Therefore, the smoothness can be calculated accurately and stably according the detection results.

The irradiated area E is positioned within the hypothetical flat surface of the recording sheet S, that is, within the flat surface substantially conforming to the inner surface of the conveyance guide board 17. Accordingly, the sensor 70 easily detects the smoothness of the recording sheet S, even if the sensor 70 has a relatively low sensitivity in the depth direction. Therefore, the smoothness can be calculated accurately and stably according the detected data.

In the present embodiment, the predetermined emission angle of the optical axis Q1 of the detection light 73 that is emitted by the light-emitting device 71 and the predetermined reflection angle of the optical axis Q2 of the reflected light received by the light-receiving device 72 are set within a range from about 10° to about 14°. Accordingly, the surface roughness of the recording sheet S can be effectively detected and components costs of the sensor 70 can be reduced.

Figure 12:
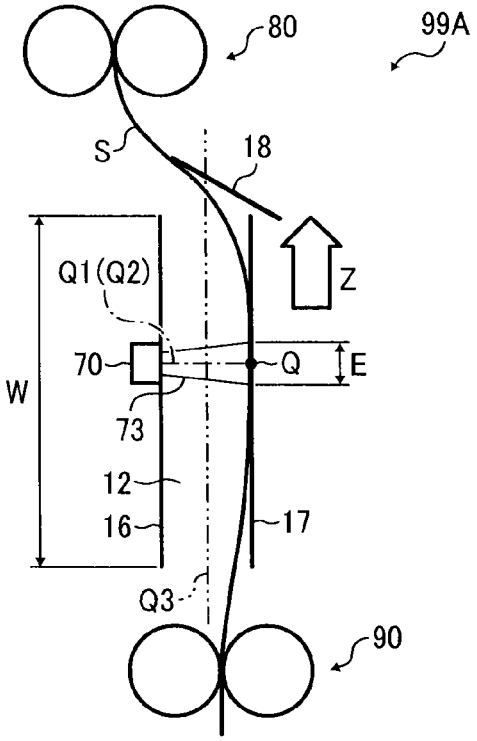
FIG. 12 is a sectional view of a detection and regulation portion according to a second embodiment that includes a regulation board, illustrating the trough of the recording sheet is in the irradiation range including the intersection of the sensor.

Referring now to FIG. 12, a description is given of a detection and regulation portion 99A according to a second embodiment of the present invention.

FIG. 12 is a sectional view of the detection and regulation portion 99A.

In the first embodiment described above, the registration device 80 is used as a regulator. According to the second embodiment, the detection and regulation portion 99A includes the regulation board 18 as a regulator. The regulation board 18 may be used together with the registration device 80 as a regulator.

As illustrated in FIG. 12, the regulation board 18 is disposed downstream from the detection section W and upstream from the registration device 80 in the conveyance direction Z. A downstream end of the regulation board 18 is tilted toward the registration device 80

The regulation board 18 orients the recording sheet S toward the regulation board 18, thereby facilitating regulation of the recording sheet S.

Figure 13:
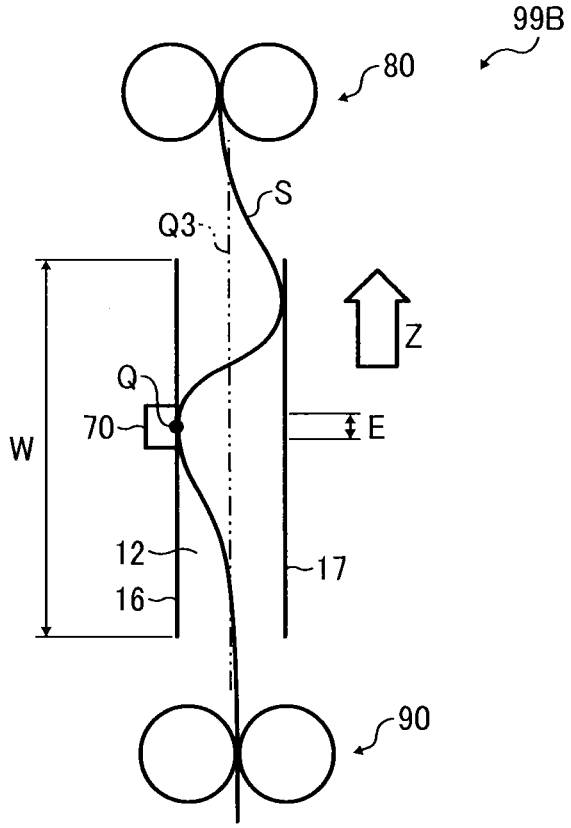
FIG. 13 is a sectional view of a detection and regulation portion according to a third embodiment illustrating a ridge of the recording sheet is in the irradiation range including the intersection of the sensor.
Figure 14:
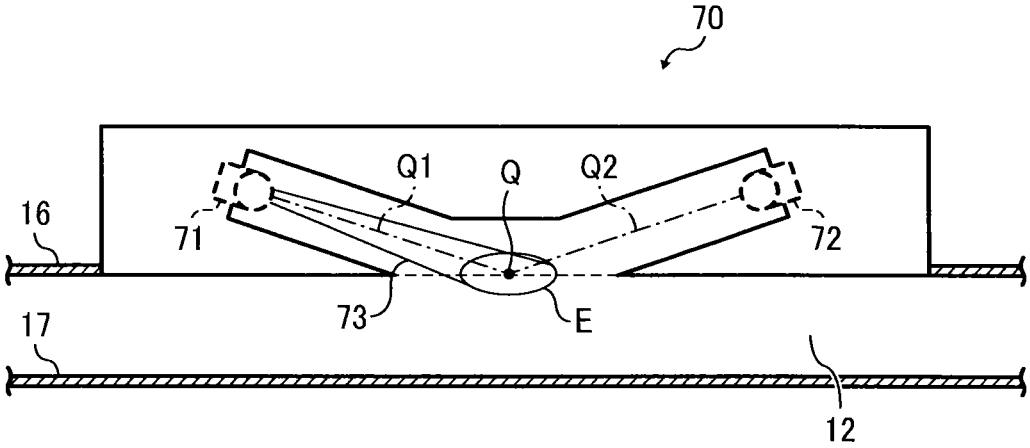
FIG. 14 is a sectional view of a detection portion of the detection and regulation portion of FIG. 13, illustrating a position of the intersection of the sensor.

Referring now to FIGS. 13 and 14, a description is given of a detection and regulation portion 99B according to a third embodiment of the present invention.

FIG. 13 is a sectional view of the detection and regulation portion 99B. FIG. 14 is a detection portion of the detection and regulation portion 99B.

In the first embodiment, the intersection Q of the sensor 70 is positioned in the flat surface substantially conforming to the inner surface of the conveyance guide board 17. According to the third embodiment, the intersection Q is positioned on an inner surface side of the conveyance guide board 16, as illustrated in FIG. 13.

Specifically, as illustrated in FIG. 14, the intersection Q of the optical axis Q1 and the optical axis Q2 is positioned on the inner surface side of the conveyance guide board 16, that is, substantially in front of the sensor 70. The irradiated area E is an area having a certain depth from a flat surface substantially the same as the inner surface of the conveyance guide board 16. The registration device 80 serving as a regulator, which may be used together with the regulation board 18, regulates the conveyance of the recording sheet S, such that a ridge of the front surface of the recording sheet S contacts the inner surface of the conveyance guide board 16.

In the third embodiment, the registration device 80 sandwiches the recording sheet S between its rollers at a position closer to the reference conveyance axis Q3 than the position where the registration device 80 of the first embodiment sandwiches the recording sheet S between its rollers. Accordingly, the conveyance of the recording sheet S is regulated such that one trough and one ridge are formed on the front surface of the recording sheet S between the registration device 80 and the pair of conveyance rollers 90 or in the detection section W.

In other words, the sensor 70 can correctly detect the smoothness on either the trough or the ridge of the surface of the recording sheet S according to the depth of the sensor 70 (i.e., the position of the intersection Q). Accordingly, the conveyance of the recording sheet S is regulated such that the ridge of the surface of the recording medium P contacts the conveyance guide board 16 on which side the sensor 70 is placed and the trough of the surface of the recording medium P contacts the conveyance guide board 17 opposite the conveyance guide board 16 to prevent a shift of the recording sheet S in the depth direction in which the sensor 70 has a relatively low sensitivity. As a result, the sensor 70 can detect correctively and stably the smoothness of the recording sheet S. When the conveyance of the recording sheet S is regulated such that the ridge of the surface of the recording medium P faces the sensor 70, the predetermined emission angle of the optical axis Q1 and the predetermined reflection angle of the optical axis Q2 can be shallow, thereby enhancing the detection accuracy.

As described above, according to the embodiments of the present invention, an image forming apparatus (e.g., image forming apparatus 1) includes a conveyance passage unit (e.g., conveyance passage 12), a fixing device (e.g., fixing device 60), an optical sensor (e.g., sensor 70), a fixing condition adjuster (e.g., fixing condition calculator 78), and a regulator (e.g., registration device 80). A recording medium (e.g., recording sheet S) is conveyed through the conveyance passage unit. The fixing device fixes a toner image onto the recording medium conveyed through the conveyance passage unit. The optical sensor includes a light-emitting device (e.g., light-emitting device 71) and a light-receiving device (e.g., light-receiving device 72). The light-emitting device emits detection light (e.g., detection light 73) toward the conveyance passage unit. The light-receiving device receives light reflected from a surface of the recording medium conveyed through the conveyance passage unit. The optical sensor detects smoothness of the recording medium according to strength of the light received. The fixing condition adjuster adjusts fixing conditions according to the smoothness detected by the optical sensor. The regulator is disposed in the conveyance passage unit to regulate conveyance of the recording medium, such that at least a part of the recording medium passes through a predetermined irradiated area (e.g., irradiated area E) including an intersection (e.g., intersection Q). The intersection is determined by a predetermined emission angle of a first optical axis (e.g., optical axis Q1) of the detection light that is emitted by the light-emitting device and a predetermined reflection angle of a second optical axis (e.g., optical axis Q2) of the reflected light received by the light-receiving device.

The regulator regulates the conveyance of the recording medium, such that a ridge or a trough of the recording medium extending in a direction that intersects a conveyance direction of the recording medium (e.g., conveyance direction Z) is positioned in the irradiated area. Accordingly, the optical sensor can detect easily and correctly the smoothness of the recording medium.

The irradiated area is positioned within a hypothetical flat surface of the recording medium when stably conveyed. Accordingly, the optical sensor can easily detect the smoothness of the recording medium, even if the optical sensor has a relatively low sensitivity in a depth direction. In addition, the smoothness can be calculated accurately and stably according the detected data.

The predetermined emission angle of the first optical axis and the predetermined reflection angle of the second optical axis are set within a range from 10° to 14°. Accordingly, a surface roughness of the recording medium can be effectively detected.

The first optical axis and the second optical axis are perpendicular to the conveyance direction of the recording medium. Accordingly, the optical sensor can detect the smoothness of the recording medium even if the detection section is relatively short. As a result, the body can be compact and flexibly designed.

The image forming apparatus further includes a pair of conveyance guide boards (e.g., conveyance guide boards 16 and 17) and a pair of first conveyance rollers (e.g., registration device 80). The pair of conveyance guide boards is disposed facing each other disposed in the conveyance passage unit to define a conveyance height (e.g., conveyance height L) in a thickness direction of the recording medium and the conveyance direction of the recording medium to form a detection section (e.g., detection section W). The pair of first conveyance rollers is disposed downstream from the detection section in the conveyance direction of the recording medium in the conveyance passage unit. The optical sensor is positioned at one of the pair of conveyance guide boards, and is disposed in the detection section. The regulator is the pair of first conveyance rollers that forms a nip between roller of the pair of first conveyance rollers to convey the recording medium at a position shifted to one side of a reference conveyance axis (e.g., reference conveyance axis Q3) in a direction of the conveyance height. The reference conveyance axis passes through a center of the pair of conveyance guide boards in the direction of the conveyance height while extending in the conveyance direction of the recording medium.

The regulator further includes a regulation board (e.g., regulation board 18). The regulation board is disposed downstream from the detection section and upstream from the registration device in the conveyance direction of the recording medium. A downstream end of the regulation board in the conveyance direction of the recording medium is tilted toward the registration device. The regulation board facilitates regulation of the conveyance of the recording medium.

The irradiated area is positioned within a flat surface of one of the pair of conveyance guide boards. Accordingly, the optical sensor can detect correctly and stably the smoothness of the recording medium, even if the optical sensor has a relatively low sensitivity in the depth direction. In addition, component costs of the optical sensor can be reduced.

The pair of conveyance guide boards extends vertically, thereby contributing to a compact body of the image forming apparatus.

The image forming apparatus further includes a pair of second conveyance rollers (e.g., pair of conveyance rollers 90). The pair of second conveyance rollers is disposed upstream from the pair of conveyance guide boards in the conveyance direction of the recording medium in the conveyance passage unit. The pair of first conveyance rollers and the pair of second conveyance rollers regulate the conveyance of the recording medium, such that at least one ridge and at least one trough of the recording medium are formed between the pair of first conveyance rollers and the pair of second conveyance rollers. Accordingly, the optical sensor can detect the smoothness of the recording medium on the ridge or the trough of the recording medium according to a position of the intersection. Accordingly, the image forming apparatus can be designed with greater flexibility, including a position of the optical sensor.

Thus, the image forming apparatus according to the embodiments described above contributes to optimization of a position of the recording medium at which the recording medium faces a smoothness sensor while being conveyed, and further contributes to enhancement in detection accuracy and stabilization of detection results. Accordingly, the image forming apparatus has advantages as an image forming apparatus that detects surface smoothness of a recording medium.

The present invention has been described above with reference to specific exemplary embodiments. It is to be noted that the present invention is not limited to the details of the embodiments described above, but various modifications and enhancements are possible without departing from the scope of the invention. It is therefore to be understood that the present invention may be practiced otherwise than as specifically described herein. For example, elements and/or features of different illustrative exemplary embodiments may be combined with each other and/or substituted for each other within the scope of this invention. The number of constituent elements and their locations, shapes, and so forth are not limited to any of the structure for performing the methodology illustrated in the drawings.

What is claimed is:

1. An image forming apparatus comprising:

a conveyance passage unit through which a recording medium is conveyed;

a fixing device to fix a toner image onto the recording medium conveyed through the conveyance passage unit;

an optical sensor including a light-emitting device to emit detection light toward the conveyance passage unit and a light-receiving device to receive light reflected from a surface of the recording medium conveyed through the conveyance passage unit, the optical sensor detecting smoothness of the recording medium according to strength of the light received;

a fixing condition adjuster to adjust fixing conditions according to the smoothness detected by the optical sensor;

a regulator, disposed in the conveyance passage unit, to regulate conveyance of the recording medium, such that at least a part of the recording medium passes through a predetermined irradiated area including an intersection that is determined by a predetermined emission angle of a first optical axis of the detection light emitted by the light-emitting device and a predetermined reflection angle of a second optical axis of the reflected light received by the light-receiving device, and a pair of conveyance guide boards disposed facing each other in the conveyance passage unit to define a conveyance height in a thickness direction of the recording medium and the conveyance direction of the recording medium, to form a detection section, wherein a reference conveyance axis passes through a center of the pair of conveyance guide boards in the direction of the conveyance height while extending in the conveyance direction of the recording medium.

2. The image forming apparatus according to claim 1, wherein the regulator regulates the conveyance of the recording medium, such that a ridge of the recording medium extending in a direction intersecting a conveyance direction of the recording medium is positioned in the irradiated area.

3. The image forming apparatus according to claim 1, wherein the regulator regulates the conveyance of the recording medium, such that a trough of the recording medium extending in a direction intersecting a conveyance direction of the recording medium is positioned in the irradiated area.

4. The image forming apparatus according to claim 1, wherein the irradiated area is positioned within a hypothetical flat surface of the recording medium when stably conveyed.

5. The image forming apparatus according to claim 1, wherein the predetermined emission angle of the first optical axis and the predetermined reflection angle of the second optical axis are set within a range from 10° to 14°.

6. The image forming apparatus according to claim 1, wherein the first optical axis and the second optical axis are perpendicular to the conveyance direction of the recording medium.

7. The image forming apparatus according to claim 1, further comprising:

a pair of first conveyance rollers disposed downstream from the detection section in the conveyance direction of the recording medium in the conveyance passage unit, wherein the optical sensor is positioned at one of the pair of conveyance guide boards, and is disposed in the detection section, and wherein the regulator is the pair of first conveyance rollers forming a nip between rollers of the pair of first conveyance rollers to convey the recording medium at a position shifted to one side of the reference conveyance axis in a direction of the conveyance height.

8. The image forming apparatus according to claim 7, wherein the regulator further comprises a regulation board disposed downstream from the detection section and upstream from the pair of first conveyance rollers in the conveyance direction of the recording medium and having a downstream end in the conveyance direction of the recording medium tilted toward the pair of first conveyance rollers.

9. The image forming apparatus according to claim 7, wherein the irradiated area is positioned within a flat surface of one of the pair of conveyance guide boards.

10. The image forming apparatus according to claim 7, wherein the pair of conveyance guide boards extend vertically.

11. The image forming apparatus according to claim 7, further comprising a pair of second conveyance rollers disposed upstream from the pair of conveyance guide boards in the conveyance direction of the recording medium in the conveyance passage unit, and wherein the pair of first conveyance rollers and the pair of second conveyance rollers regulate the conveyance of the recording medium, such that at least one ridge and at least one trough of the recording medium are formed between the pair of first conveyance rollers and the pair of second conveyance rollers.

12. An image forming apparatus comprising:

a conveyance passage unit through which a recording medium is conveyed;

a fixing device to fix a toner image onto the recording medium conveyed through the conveyance passage unit;

an optical sensor including a light-emitting device to emit detection light toward the conveyance passage unit and a light-receiving device to receive light reflected from a surface of the recording medium conveyed through the conveyance passage unit, the optical sensor detecting smoothness of the recording medium according to strength of the light received;

a fixing condition adjuster to adjust fixing conditions according to the smoothness detected by the optical sensor; and a regulator, disposed in the conveyance passage unit, to regulate conveyance of the recording medium, such that at least a part of the recording medium passes through a predetermined irradiated area including an intersection that is determined by a predetermined emission angle of a first optical axis of the detection light emitted by the light-emitting device and a predetermined reflection angle of a second optical axis of the reflected light received by the light-receiving device, wherein the predetermined emission angle of the first optical axis and the predetermined reflection angle of the second optical axis are set within a range from 10° to 14°, and wherein the first optical axis and the second optical axis are perpendicular to the conveyance direction of the recording medium.

* * * * *